US008317189B2

(12) United States Patent
Ueda et al.

(10) Patent No.: US 8,317,189 B2
(45) Date of Patent: Nov. 27, 2012

(54) SHEET FEEDING APPARATUS AND IMAGE FORMING APPARATUS

(75) Inventors: Shinichi Ueda, Mishima (JP); Shuji Nishitani, Numazu (JP); Kazushi Nishitaka, Odawara (JP); Masato Tanabe, Suntou-gun (JP); Satoshi Tsuda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/198,942

(22) Filed: Aug. 5, 2011

(65) Prior Publication Data

US 2012/0061908 A1 Mar. 15, 2012

(30) Foreign Application Priority Data

Sep. 13, 2010 (JP) ..... 2010-204737

(51) Int. Cl.
*B65H 1/00* (2006.01)
*B65H 1/04* (2006.01)

(52) U.S. Cl. ..... 271/171; 271/145
(58) Field of Classification Search ..... 271/171, 271/145
See application file for complete search history.

(56) References Cited

U.S. PATENT DOCUMENTS

| | | | | |
|---|---|---|---|---|
| 6,877,742 | B2 | 4/2005 | Nishikata et al. | |
| 7,032,900 | B2 | 4/2006 | Nishikata et al. | |
| 7,871,072 | B2 * | 1/2011 | Rowe et al. | 271/234 |
| 7,979,002 | B2 | 7/2011 | Nishikata et al. | |
| 8,191,892 | B2 * | 6/2012 | Fuda | 271/241 |
| 2011/0227274 | A1 | 9/2011 | Nishikata et al. | |

FOREIGN PATENT DOCUMENTS

| | | | |
|---|---|---|---|
| JP | 2000-118730 | A | 4/2000 |
| JP | 2000-219330 | A | 8/2000 |

* cited by examiner

*Primary Examiner* — Luis A Gonzalez
(74) *Attorney, Agent, or Firm* — Fitzpatrick, Cella, Harper & Scinto

(57) ABSTRACT

A movable side regulating plate is provided on a frame body. The movable side regulating plate regulates side edges in a width direction of sheets stacked on a sheet stacking plate, and is movable in the width direction. A sheet pressing portion configured to press the side edges of the sheets and press the sheets onto a stationary side regulating plate is provided on the movable side regulating plate. The sheet pressing portion has a relief shape for reducing a pressing force exerted on the sheets when an amount of the sheets stacked on the sheet stacking plate becomes equal to or smaller than a predetermined amount. The relief shape is formed so that a downstream edge in a sheet feeding direction of a lower surface is located higher than an upstream edge in the sheet feeding direction of an upper surface.

10 Claims, 9 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to configurations of side edge regulating portions configured to regulate positions of side edges of sheets stored in a sheet feeding cassette detachably mounted to an apparatus main body.

2. Description of the Related Art

There is now widely used an image forming apparatus, such as a copier, printer, or facsimile, in which a sheet feeding apparatus is used to feed a sheet to an image forming portion, to thereby form an image. Further, in such a sheet feeding apparatus, in general, a sheet feeding cassette is detachably mounted to an apparatus main body, and sheets stored in the sheet feeding cassette are automatically fed to the image forming portion.

Examples of the sheet feeding cassette used in such a sheet feeding apparatus include one in which a lifting plate for stacking sheets thereon and pressing the sheets onto a sheet feeding roller is provided so as to freely rise and lower. In addition, in the sheet feeding cassette provided with such a lifting plate, a trailing edge regulating portion for regulating positions of upstream edges (hereinafter, referred to as trailing edges) in a sheet feeding direction of the sheets stacked and stored on the lifting plate is provided so as to be slidable in order that sheets having different sizes can be stored. Further, the sheet feeding cassette is provided with a pair of side edge regulating portions for regulating side edge positions of the sheet in a direction (hereinafter, referred to as width direction) orthogonal to the sheet feeding direction.

Further, the pair of side edge regulating portions regulates the side edges of the sheet, whereas the trailing edge regulating portion regulates the trailing edge of the sheet. Accordingly, a leading edge position of the sheet is always regulated to be located at a predetermined position. With this configuration, when the sheet feeding cassette is accommodated to the apparatus main body, it is possible to perform a stable sheet feeding operation regardless of a sheet size.

Examples of the sheet feeding cassette provided with such side edge regulating portions include one in which one of the side edge regulating portions is fixed, whereas the other of the side edge regulating portions is slidable in the width direction. Further, the fixed one of the side edge regulating portions (hereinafter, referred to as a stationary side edge regulating portion) is used as a reference surface in the width direction for the sheets. By feeding the sheet along the stationary side edge regulating portion, a predetermined printing accuracy is achieved.

By the way, in the sheet feeding cassette as described above, in a case where an attachment/detachment direction of the sheet feeding cassette is aligned parallel with the width direction, when the sheet feeding cassette is set, the sheets may be shifted due to an inertial force and separated from the stationary side edge regulating portion. Thus, conventionally, of the pair of side edge regulating portions, the slidable side edge regulating portion (hereinafter, referred to as a movable side edge regulating portion) is provided with a sheet pressing portion for pressing the sheets. Further, in a case where the sheets are shifted, the sheet pressing portion pushes back the shifted sheets to the stationary side edge regulating portion.

Here, in order to push back the thus shifted sheets to an original position, it is necessary to make a pressing force of the sheet pressing portion strong. However, in a case where the pressing force of the sheet pressing portion is set to such a magnitude as to be capable of pushing back the sheets when an amount of stack of the sheets is large, for example, at the time of full-level stack of the sheets, the sheets warp on the lifting plate at the time of low-level stack when the amount of stack of the sheets is small, and hence cannot keep appropriate postures. That is, in a case where the pressing force of the sheet pressing portion is set to such a magnitude as to be capable of pushing back the sheets to the original position at the time of full-level stack, the sheets warp on the lifting plate at the time of low-level stack, and hence cannot keep appropriate postures.

In this context, conventionally, there is proposed an invention which prevents occurrence of warpage of the sheets at the time of low-level stack while increasing the pressing force to the sheets at the time of full-level stack. For example, the following configuration is proposed. Specifically, the pressing force of the sheet pressing portion is actively varied using a link, and the pressing force is weakened under a state in which the amount of stack of the sheets is small. This technology is disclosed in Japanese Patent Application Laid-Open No. 2000-118730. However, with this configuration, the number of components increases, and hence cost increases. Thus, in order not to increase the number of components, the following configuration is proposed. Specifically, a relief surface is formed on the sheet pressing portion. Owing to the relief surface, at the time of low-level stack, the pressing force of the sheet pressing portion is reduced, or the sheets are prevented from contacting with the sheet pressing portion so that the sheet pressing portion does not press the sheets. This technology is disclosed in Japanese Patent Application Laid-Open No. 2000-219330.

Note that, FIGS. 8A and 8B are perspective views illustrating a sheet feeding cassette provided with a movable side edge regulating portion in which a relief surface is formed on a sheet pressing portion. FIG. 8A illustrates a state in which an amount of stack of sheets S is small, and FIG. 8B illustrates a state in which the amount of stack of the sheets S is full. Here, in this state, a lifting plate 713 is raised by an urging unit (not shown), and the sheets S on the lifting plate 713 are held in press-contact with a sheet feeding roller 708. Further, at this time, a movement in the width direction of the sheets S is regulated by a stationary side edge regulating portion 714 and a movable side edge regulating portion 715. Further, of sheet pressing portions 716 and 717 provided on the movable side edge regulating portion 715, the sheet pressing portion 716, which is located at the center portion in the sheet feeding direction indicated by an arrow, has a relief shape 716*a* formed for reducing the pressing force exerted on the sheets S at the time of low-level stack.

However, in the above-mentioned sheet feeding apparatus and image forming apparatus, for example, in a case where the relief surface is formed on the sheet pressing portion, as illustrated in FIG. 9A, a space 716*b* is formed below the relief shape 716*a* and between the sheets S and the sheet pressing portion 716 at the time of full-level stack of the sheets. Thus, when the sheet feeding cassette is inclined under a state in which the sheets S are set, or when impact is generated when the sheet feeding cassette is attached to the apparatus main body, as illustrated in FIG. 9B, of the sheets S, the sheets that are not held in contact with the sheet pressing portion 716 are shifted into the space 716*b*. When the lifting plate 713 is raised in this state, there is a risk in that the shifted sheets hamper the pressing force of the sheet pressing portion 716 exerted by a spring 901, or the shifted sheets S are fed in the shifted postures.

In recent years, the sheet feeding cassette is required to store a wide variety of sheets and to have higher stacking performance. However, with the above-mentioned conventional configuration, it is difficult to achieve sufficient feeding performance.

SUMMARY OF THE INVENTION

Therefore, the present invention has been made in view of the above-mentioned circumstances, and it is an object of the present invention to provide a sheet feeding apparatus and an image forming apparatus capable of reliably holding the sheets at an appropriate position and preventing warpage of the sheets at the time of low-level stack with a simple configuration.

The present invention provides a sheet feeding apparatus, which feeds, by a sheet feeding portion, sheets stored in a sheet feeding cassette detachably mounted to an apparatus main body, the sheet feeding apparatus comprising: the sheet feeding cassette including: a cassette main body in which the sheets are stored; a sheet stacking portion provided on the cassette main body so as to pivot in an up-down direction, the sheet stacking portion pressing the stacked sheets onto the sheet feeding portion, and pivoting sequentially and upward when the sheets are fed so that an amount of stack of the sheets is reduced; a pair of side edge regulating portions provided on the cassette main body to be opposed to each other, and configured to regulate positions of side edges in a width direction orthogonal to a sheet feeding direction of the sheets stacked on the sheet stacking portion, at least one of the pair of side edge regulating portions being movable in the width direction; and a sheet pressing portion provided in an urged state on the one of the pair of side edge regulating portions, the sheet pressing portion pressing the side edges of the sheets, and pressing the sheets onto another one of the pair of side edge regulating portions, the sheet pressing portion including: a pressing portion configured to press the side edges of the sheets; and a recessed portion intersecting the pressing portion, the recessed portion being formed to be inclined so that a downstream edge in the sheet feeding direction of a lower surface of the recessed portion is located higher than an upstream edge in the sheet feeding direction of an upper surface of the recessed portion.

Further features of the present invention will become apparent from the following description of exemplary embodiments with reference to the attached drawings.

DESCRIPTION OF THE EMBODIMENTS

Figure 1:
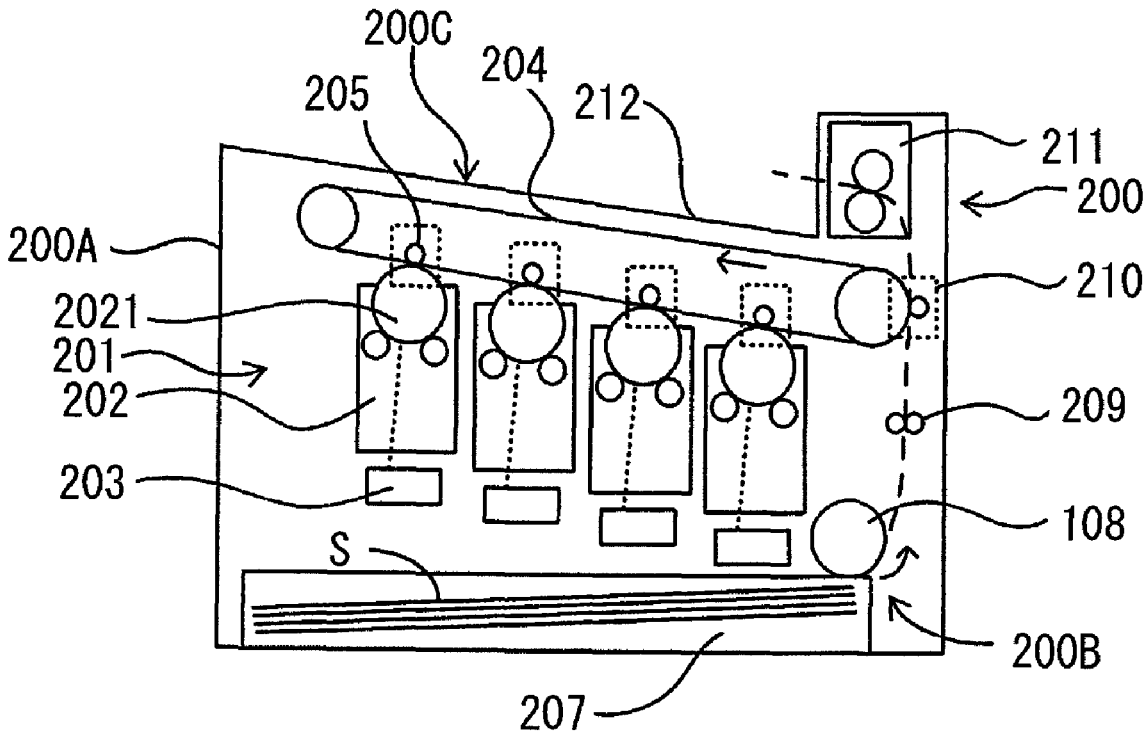
FIG. 1 is a view illustrating a configuration of a laser printer as an example of an image forming apparatus according to a first embodiment of the present invention.

Hereinafter, embodiments of the present invention will be described in detail with reference to the drawings. FIG. 1 is a view illustrating a configuration of a laser printer as an example of an image forming apparatus according to a first embodiment of the present invention. FIG. 1 illustrates a laser printer (hereinafter, referred to as a printer) 200 having a laser printer main body (hereinafter, referred to as a printer main body) 200A. The printer main body 200A includes an image forming portion 201 configured to form an image on a sheet S, and a sheet feeding apparatus 200B for feeding the sheet S from a sheet feeding cassette 207.

The image forming portion 201 includes a scanner unit 203, and four process cartridges 202 configured to form toner images of four colors, that is, yellow (Y), magenta (M), cyan (C), and black (Bk), respectively. The image forming portion 201 further includes an intermediate transfer unit 200C provided above the process cartridges 202. Here, each of the process cartridges 202 includes a photosensitive drum 2021.

The intermediate transfer unit 200C includes an intermediate transfer belt 204, and primary transfer rollers 205 which are provided inside the intermediate transfer belt 204 and are each brought into contact with the intermediate transfer belt 204 at a position opposed to the photosensitive drum 2021. Further, the primary transfer roller 205 applies a transfer bias having positive polarity to the intermediate transfer belt 204, with the result that the toner image of each color having negative polarity on the photosensitive drum is sequentially multiple-transferred onto the intermediate transfer belt 204. In this manner, a full-color image is formed on the intermediate transfer belt.

Next, an image forming operation of the printer 200 configured as described above will be described. When the image forming operation is started, the scanner unit 203 first irradiates laser light according to image information from a personal computer (not shown) or the like, and sequentially exposes a surface of the photosensitive drum 2021 uniformly charged to a predetermined polarity and potential, to thereby form an electrostatic latent image on the photosensitive drum. After that, the electrostatic latent image is developed with a toner, and then visualized.

Then, a yellow toner image, a magenta toner image, a cyan toner image, and a black toner image formed on the photosensitive drums 2021 of the respective process cartridges 202 are transferred onto the intermediate transfer belt 204 at primary transfer portions by the primary transfer rollers 205. In this manner, a full-color toner image is formed on the intermediate transfer belt 204.

Further, along with the toner image forming operation, the sheet S stored in the sheet feeding cassette 207 is sent out by a sheet feeding roller 108 serving as a sheet feeding portion provided in the vicinity of a leading end portion of the sheet S. Then, after skew feed of the sheet S is corrected by a registration roller pair 209, the registration roller pair 209 is driven so as to align a position of the sheet S and a position of the full-color toner image on the intermediate transfer belt at a secondary transfer portion 210.

Then, the registration roller pair 209 conveys the sheet S to the secondary transfer portion 210 so as to align the position of the sheet S and the position of the full-color toner image on the intermediate transfer belt 204 at the secondary transfer portion 210. In this manner, the full-color toner image is collectively transferred onto the sheet S at the secondary transfer portion 210. Next, the sheet S on which the full-color toner image is thus transferred is conveyed to a fixing portion 211, and toners of respective colors are fused and mixed at the fixing portion 211 through application of heat and pressure and are fixed on the sheet S as a full-color image. After that, the sheet S that has passed through the fixing portion 211 is delivered onto a delivery tray 212 provided on a top surface of the printer main body, with an image side of the sheet facing downward.

By the way, the sheet feeding cassette 207 is detachably mounted to the printer main body 200A that serves also as an apparatus main body of the sheet feeding apparatus 200B. Further, in a case of replenishing the sheets, as illustrated in FIG. 2, the sheet feeding cassette 207 is drawn out of the printer main body 200A in a width direction orthogonal to a sheet feeding direction.

Figure 2:
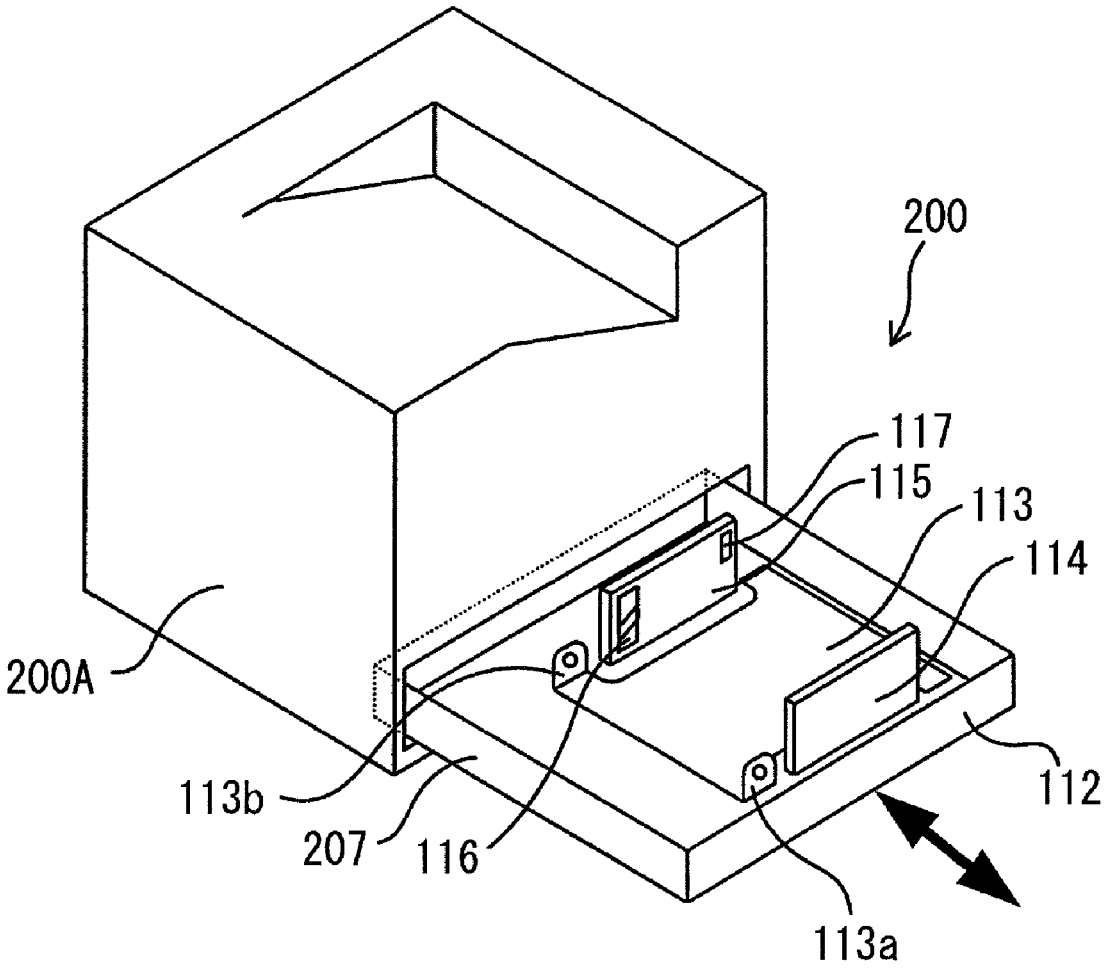
FIG. 2 is a view illustrating a configuration of a sheet feeding cassette detachably mounted to a printer main body of the laser printer.

Here, as illustrated in FIG. 2, inside a frame body 112 constituting a cassette main body of the sheet feeding cassette 207, a sheet stacking plate 113 serving as a sheet stacking portion is attached so as to be pivotable in an up-down direction using support portions 113*a* and 113*b* as a fulcrum. Further, when the stacked sheets are sequentially fed, a downstream edge portion in the sheet feeding direction of the sheet stacking plate 113 is pivoted sequentially and upward by an urging unit (not shown) interposed between the frame body 112 and the sheet stacking plate 113.

In addition, inside the frame body 112, a pair of side regulating plates 114 and 115 serving as a pair of side edge regulating portions configured to regulate positions of side edges in the width direction of the sheet S are provided opposed to each other. Here, the side regulating plate 114 is fixed to the frame body 112, and the stationary side regulating plate 114 serving as the stationary side edge regulating portion is used as a reference surface in the width direction for the sheet S. Further, when the sheet is fed, the sheet S is fed along the stationary side regulating plate 114, with the result that a predetermined printing accuracy can be achieved.

The side regulating plate 115 is slidable in the width direction, and slides in the width direction according to a size of the sheet to be stored. Note that, in this embodiment, of the side regulating plates 114 and 115, the side regulating plate 115 as at least one of the side edge regulating portions is movable, but the side regulating plate 114 as another one of the side edge regulating portions may be also similarly movable.

Further, on an inner wall surface of the movable side regulating plate 115 serving as the movable side edge regulating portion, sheet pressing portions 116 and 117 configured to press the sheets are provided. The sheet pressing portions 116 and 117 press the sheets S stacked on the sheet stacking plate 113 onto the opposing stationary side regulating plate 114. Further, owing to provision of the sheet pressing portions 116 and 117 as described above, in a case where the sheets S are shifted in the width direction and separated from the stationary side regulating plate 114 due to impact caused when pushing the sheet feeding cassette 207 into the printer main body 200A, the sheets S can be pushed back to the stationary side regulating plate 114.

Figure 3A:
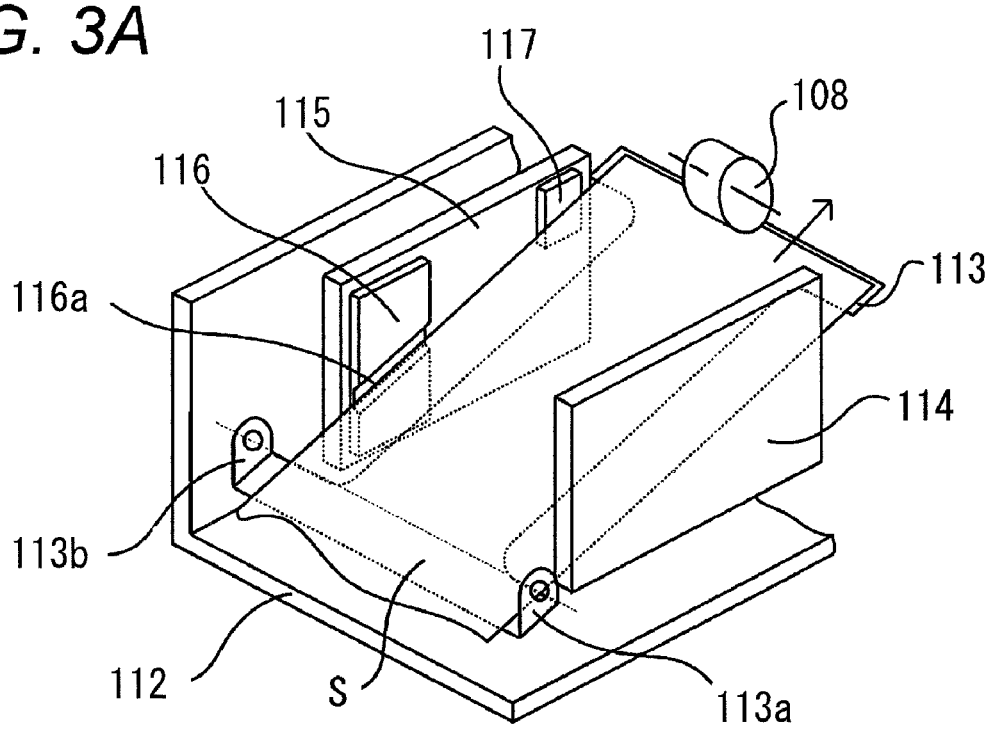
FIGS. 3A and 3B are perspective views illustrating a stacking state of the sheet feeding cassette.
Figure 3B:
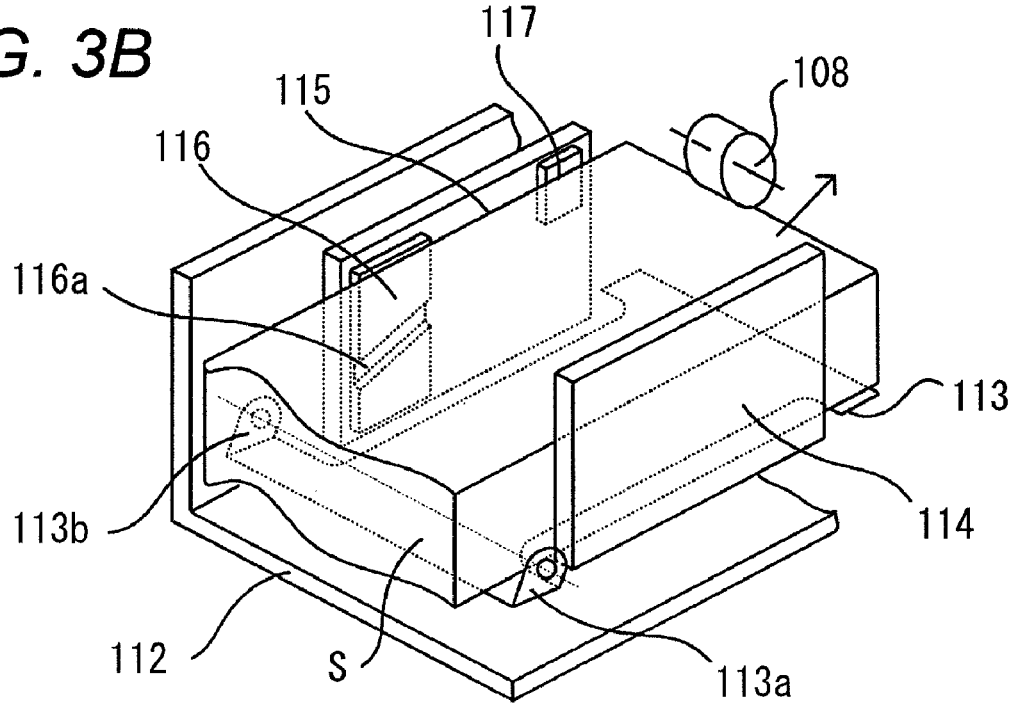

FIGS. 3A and 3B are perspective views illustrating a stacking state of the sheet feeding cassette. FIG. 3A illustrates a state in which an amount of stack of the sheets S is small. FIG. 3B illustrates a state in which the amount of stack of the sheets S is full. Here, as illustrated in FIGS. 3A and 3B, in the sheet pressing portion 116 located at the center portion in the sheet feeding direction indicated by an arrow, a relief shape 116*a* as a recessed portion intersecting the sheet pressing portion 116 is formed. Further, by forming the relief shape 116*a* in the sheet pressing portion 116 in this manner, a pressing force exerted on the sheets S by the sheet pressing portion 116 can be reduced at the time of low-level stack of the sheets S illustrated in FIG. 3A.

Note that, the sheet pressing portion 117 located on the downstream side in the sheet feeding direction of the sheet pressing portion 116 is provided on an upper portion on the downstream side in the sheet feeding direction of the movable side regulating plate 115. Owing to provision of the sheet pressing portion 117 on the movable side regulating plate 115 in this manner, even in a case where the relief shape 116*a* is formed to reduce a force of pressing the sheets as described below, it is possible to push back the sheets to the stationary side regulating plate 114 without warping the sheets.

Figure 4A:
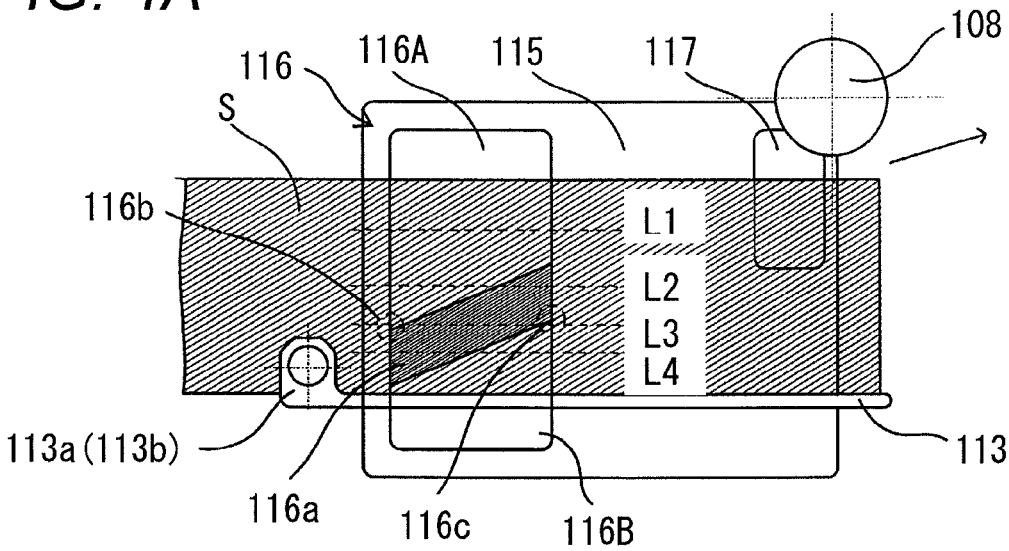
FIGS. 4A, 4B, and 4C are views illustrating a relief shape formed in a sheet pressing portion provided on the sheet feeding cassette.
Figure 4B:
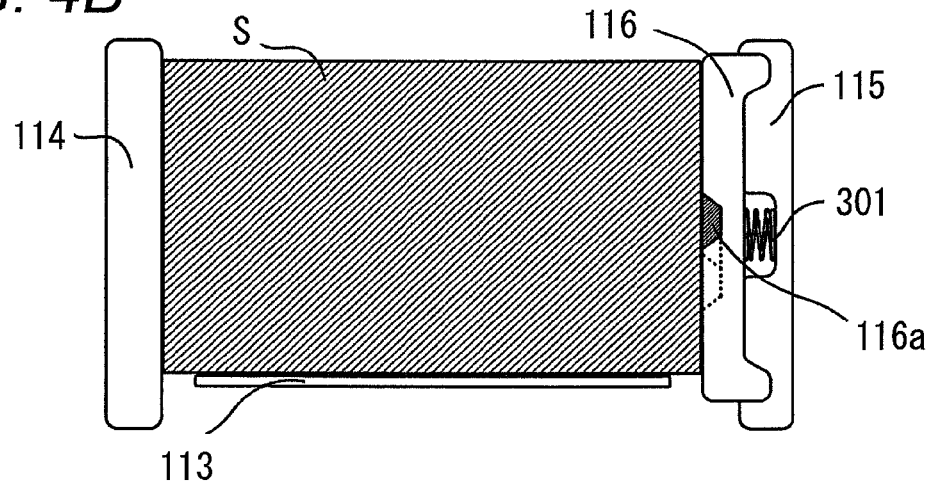

Next, the relief shape 116*a* will be described with reference to FIGS. 4A, 4B, and 4C. In FIG. 4A, a point 116*b* indicates a vertex at the lowermost end of an upper sheet pressing portion 116A of the sheet pressing portion 116 divided by the relief shape 116*a*, the upper sheet pressing portion 116A constituting the pressing portion configured to press the side edge of the sheet. In other words, the point 116*b* indicates the upstream edge in the sheet feeding direction of the upper surface of the relief shape 116*a*. A point 116*c* indicates a vertex at the uppermost end of a lower sheet pressing portion 116B of the sheet pressing portion 116 divided by the relief shape 116*a*, the lower sheet pressing portion 116B constituting the pressing portion configured to press the side edge of the sheet. In other words, the point 116*c* indicates the downstream edge in the sheet feeding direction of the lower surface of the relief shape 116*a*.

Further, the point 116*c* is provided above the point 116*b*. That is, the relief shape 116*a* is formed so that the downstream edge in the sheet feeding direction of the lower surface is located higher than the upstream edge in the sheet feeding direction of the upper surface. Further, the relief shape 116*a* is formed so that its width in the up-down direction is equal to or larger than a height of the sheets stacked on the sheet stacking plate 113 at the time of low-level stack.

With this configuration, for example, at the time of full-level stack of the sheets, all the sheets S stacked on the sheet stacking plate 113 are held in contact with the sheet pressing portion 116. In other words, when regarding all the sheets S stacked on the sheet stacking plate 113 as one rectangular parallelepiped, even when cutting off a part of the rectangular parallelepiped along any position in a thickness direction, for example, along any one of an L1 position to an L4 position, the pressing surface of the sheet pressing portion 116 appears. That is, the relief shape 116*a* is formed into the above-mentioned shape, and hence, as illustrated in FIG. 4B as a plan view of the sheet feeding cassette, the side edges of a part of the sheets S face the relief shape 116*a*, but all the sheets S are held in contact with the sheet pressing portion 116. With this configuration, at the time of full-level stack of the sheets, all the sheets S are pressed by the sheet pressing portion 116 toward the stationary side regulating plate.

Figure 4C:
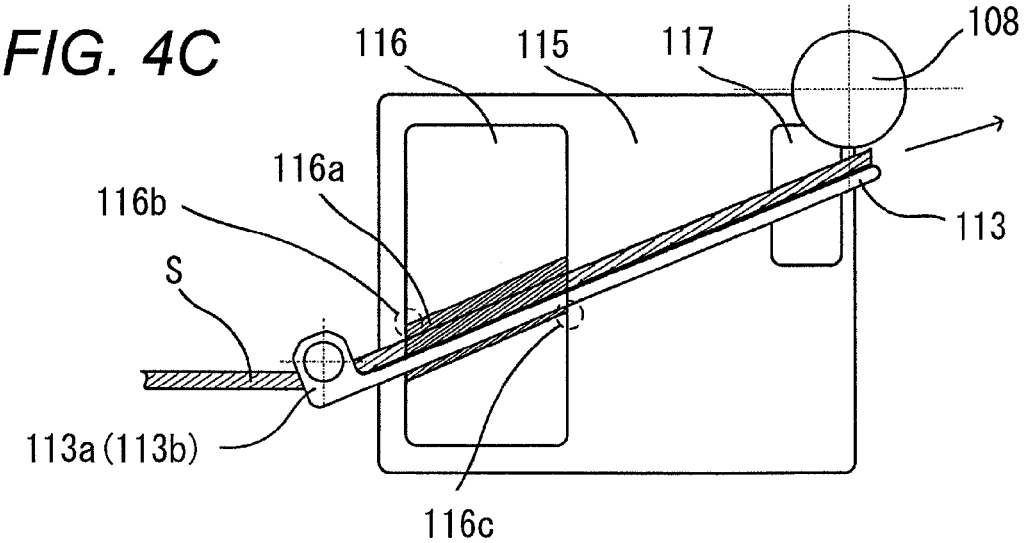

Further, when the sheet stacking plate 113 is pivoted upward by a predetermined amount in a low-level stack state as illustrated in FIG. 4C and then the sheets S on the sheet stacking plate 113 are inclined in association with the pivot, the relief shape 116*a* is substantially parallel to the sheets S. Accordingly, when the amount of stack of the sheets S is small, even when the sheets S are small-sized sheets, thin sheets, or the like, which are likely to warp due to the pressing force in the width direction, the pressing force of the sheet pressing portion 116 is reduced, and hence the sheets S do not warp. Therefore, without considering adverse effects on warpage of the sheets S in a low-level stack state, it is possible to set the pressing force of the sheet pressing portion 116 to such a magnitude as to prevent occurrence of positional shift of the sheets S in a full-level stack state of the sheets S.

As described above, owing to formation of the relief shape 116*a* having the above-mentioned shape in the sheet pressing portion 116, in a full-level stack state in which the sheet stacking plate 113 lowers, all the sheets S are held in contact with the sheet pressing portion 116. Thus, at the time of full-level stack of the sheets, all the sheets S are pressed by the sheet pressing portion 116 toward the stationary side regulating plate. Further, when the amount of stack of the sheets becomes equal to or smaller than a predetermined amount, that is, becomes smaller after feeding of the sheets and is in a low-level stack state, the pressing force exerted on the sheets can be reduced.

That is, by forming, in the sheet pressing portion 116, the relief shape 116*a* configured to reduce the pressing force exerted on the sheets when the amount of stack of the sheets becomes equal to or smaller than a predetermined amount, it is possible to reliably hold the sheets at an appropriate position, and to prevent warpage of the sheets at the time of low-level stack with a simple configuration. As a result, positional shift of all the sheets in a full-level stack state, and warpage of the sheets S at the time of low-level stack can be prevented at low cost with a simple configuration.

Figure 5:
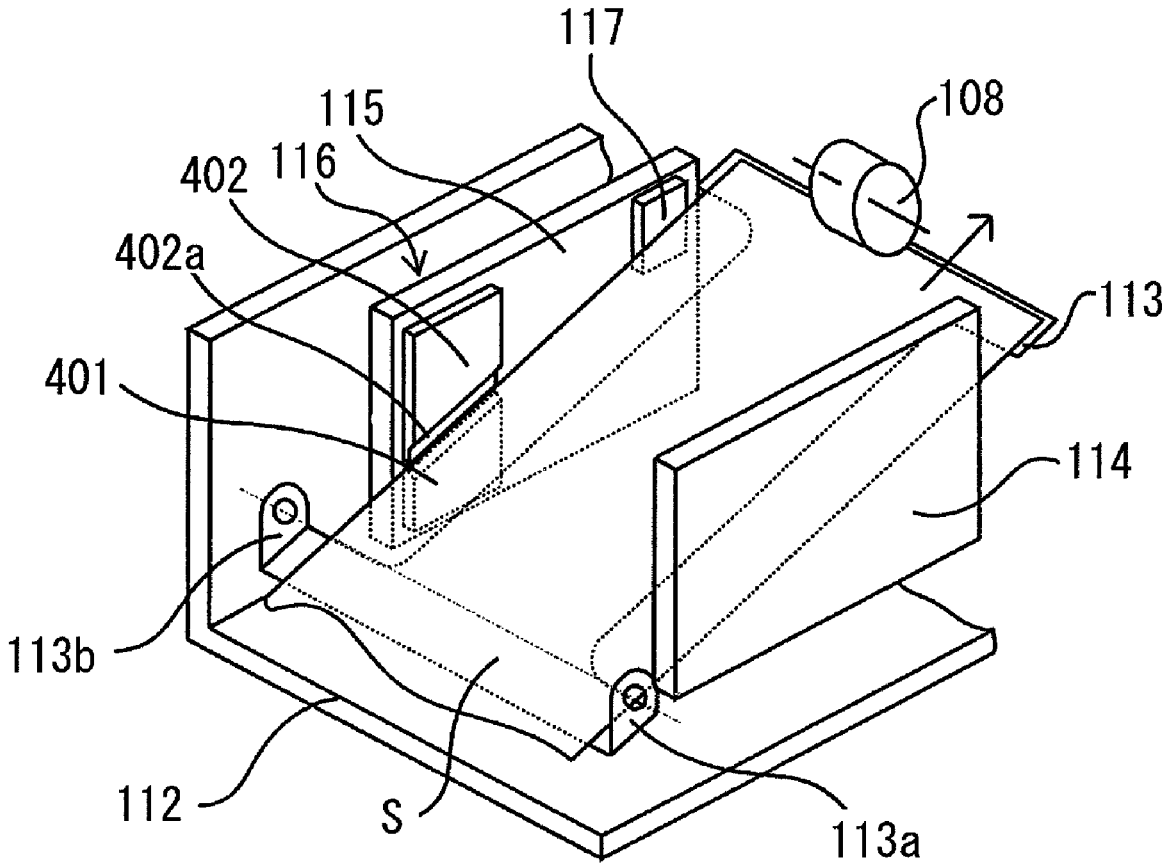
FIG. 5 is a perspective view illustrating a sheet feeding cassette mounted to an image forming apparatus according to a second embodiment of the present invention.

Next, a second embodiment of the present invention will be described. FIG. 5 is a perspective view illustrating a sheet feeding cassette mounted to an image forming apparatus according to this embodiment. Note that, in FIG. 5, components denoted by the same reference symbols as those of FIGS. 3A and 3B described above represent the same or corresponding components illustrated in FIGS. 3A and 3B.

In this embodiment, as illustrated in FIG. 5, the sheet pressing portion 116 located at the center portion in the sheet feeding direction is divided into two portions in the up-down direction, the two portions including a lower sheet pressing portion 401 and an upper sheet pressing portion 402. Here, in the upper sheet pressing portion 402, a relief shape 402*a* configured similarly to that of the first embodiment is formed, and the lower sheet pressing portion 401 is divided by the relief shape 402*a*. In this manner, in this embodiment, the sheet pressing portion 116 is constituted by the upper sheet pressing portion 402 having the relief shape 402*a*, and the lower sheet pressing portion 401 divided from the upper sheet pressing portion 402 by the relief shape 402*a*.

Here, as in this embodiment, by dividing the sheet pressing portion 116 into the lower sheet pressing portion 401 and the upper sheet pressing portion 402, the pressing force of the lower sheet pressing portion 401 and the pressing force of the upper sheet pressing portion 402 can be set independently. For example, the lower sheet pressing portion 401 does not have the relief shape 402*a*, and hence presses the sheets only in a full-level to medium-level stack state in which it is unnecessary to consider warpage of the sheets. Thus, without considering warpage of the sheets S in a low-level stack state, it is possible to determine the pressing force so as to prevent occurrence of positional shift of the sheets S in a full-level stack state. Thus, a stronger pressing force can be imparted compared to the pressing force of the upper sheet pressing portion 402, and hence more stable feeding performance can be provided at low cost with a simple configuration.

By the way, as in the above-mentioned first and second embodiments, in a case where the relief shape is formed in the sheet pressing portion 116, the pressing force exerted on the sheets S in a low-level stack state can be weakened. However, when the pressing force is extremely weak, positional shift of the sheets S may occur. Therefore, even in a case where the relief shape is formed in the sheet pressing portion 116 as described above, in order to prevent the occurrence of positional shift of the sheets S, an auxiliary sheet pressing portion may be provided in the vicinity of the relief shape or inside the relief shape.

Figure 6:
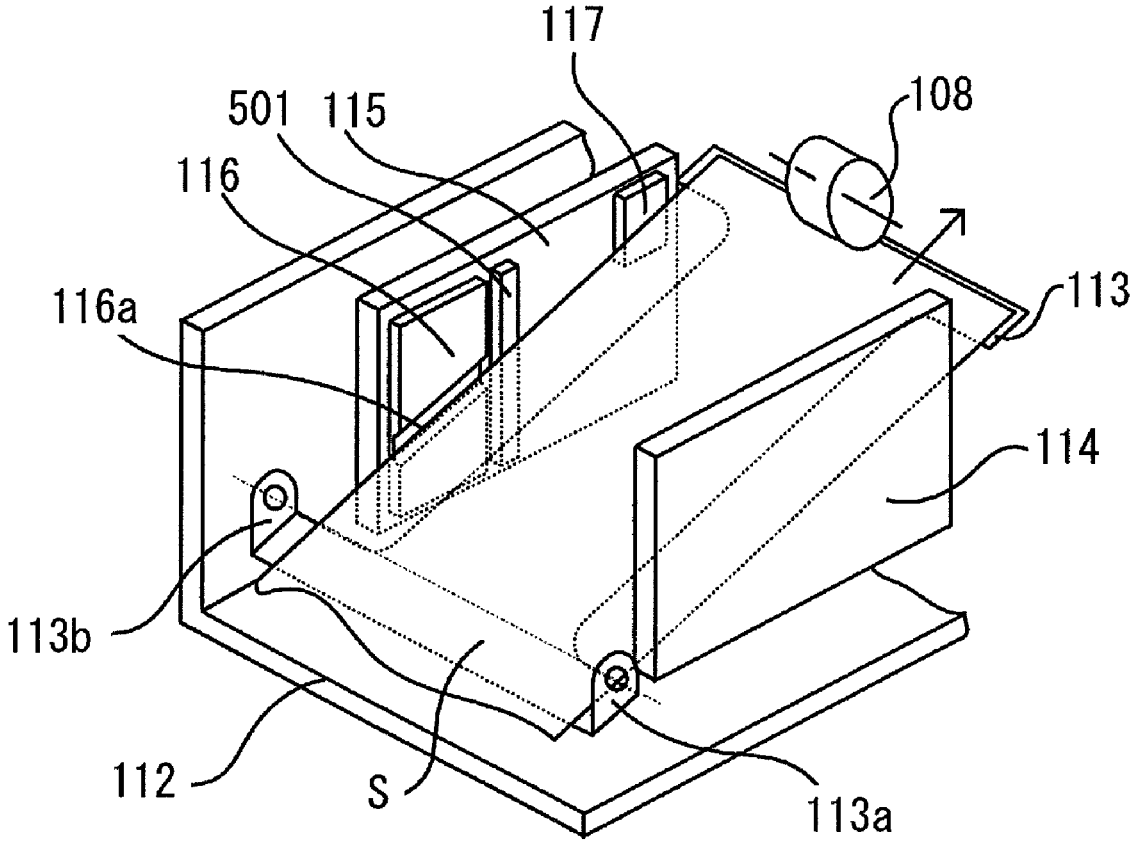
FIG. 6 is a perspective view illustrating a sheet feeding cassette mounted to an image forming apparatus according to a third embodiment of the present invention.

Next, a third embodiment of the present invention will be described, which is provided with the auxiliary sheet pressing portion as described above. FIG. 6 is a perspective view illustrating a sheet feeding cassette mounted to an image forming apparatus according to this embodiment. Note that, in FIG. 6, components denoted by the same reference symbols as those of FIGS. 3A and 3B described above represent the same or corresponding components illustrated in FIGS. 3A and 3B.

With reference to FIG. 6, an auxiliary sheet pressing portion 501 is provided in the vicinity of the sheet pressing portion 116, and extends in the up-down direction. The auxiliary sheet pressing portion 501 functions even in a case where the sheets S are in a low-level stack state. Here, the auxiliary sheet pressing portion 501 functioning even in a case where the sheets S are in a low-level stack state is provided in the vicinity of the sheet pressing portion 116 in this manner, and hence, even in a case where the relief shape 116*a* is formed in the sheet pressing portion 116, it is possible to prevent the occurrence of positional shift of the sheets S. Note that, the pressing force of the auxiliary sheet pressing portion 501 is set to be smaller than the pressing force of the sheet pressing portion 116 so as to prevent the occurrence of warpage of the sheets.

In addition, by arranging the auxiliary sheet pressing portion 501 as described above, the pressing force of the sheet pressing portion 116, which is exerted on the sheets S during feeding in a low-level stack state, can be set to a pressing force small enough to prevent the occurrence of warpage of the sheets S. As a result, the pressing force of the sheet pressing portion 116 can be set to be specialized for the low-level stack, and hence more stable feeding performance can be provided at low cost with a simple configuration.

Figure 7:
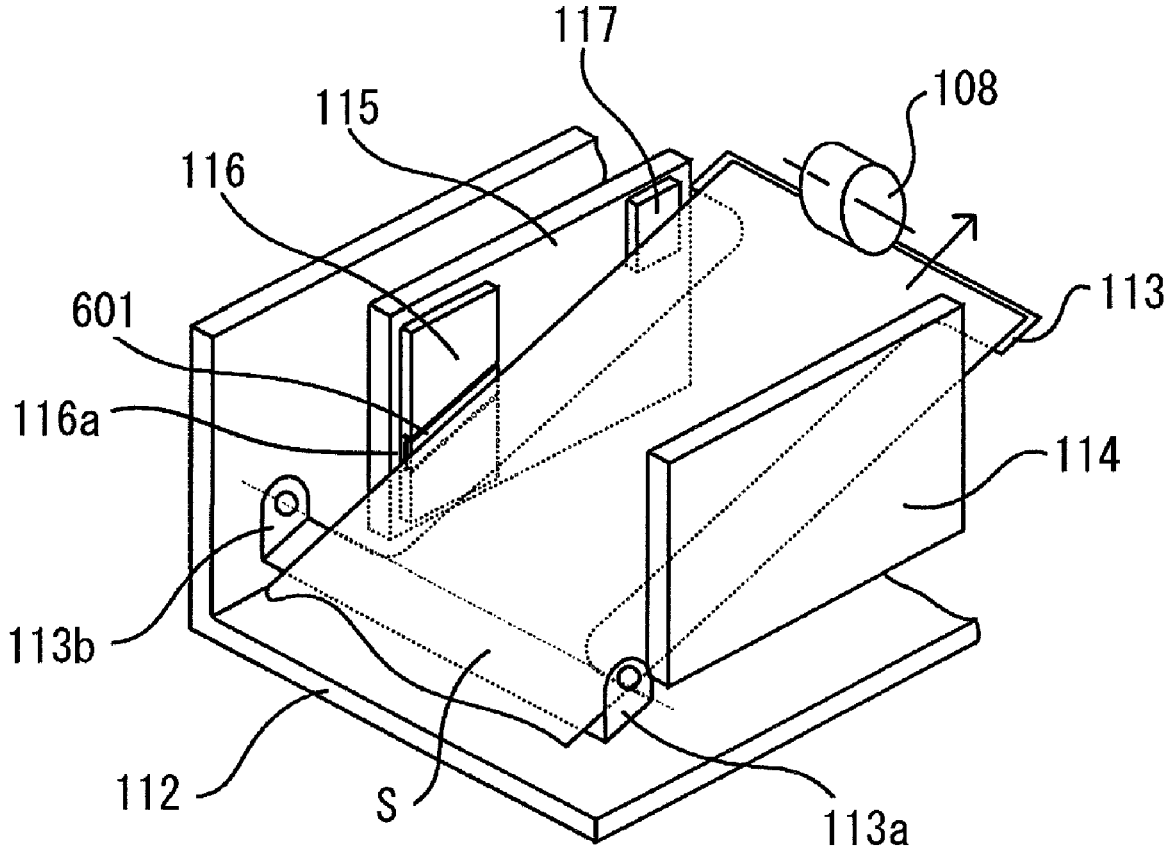
FIG. 7 is a perspective view illustrating a sheet feeding cassette mounted to an image forming apparatus according to a fourth embodiment of the present invention.
Figure 8A:
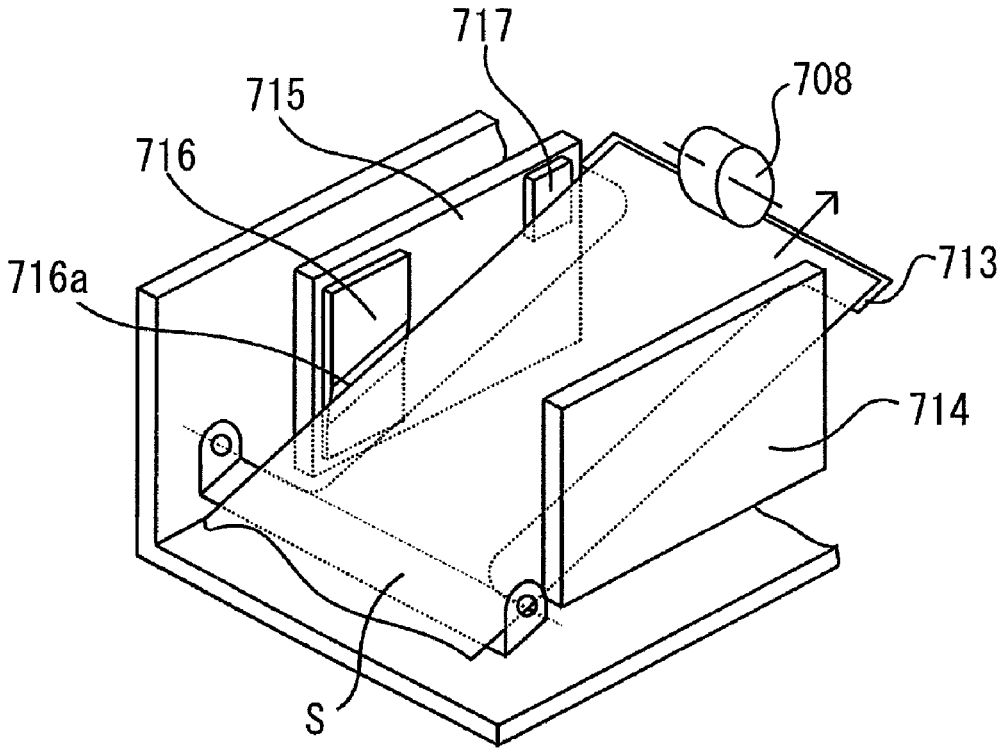
FIGS. 8A and 8B are perspective views illustrating a conventional sheet feeding cassette.
Figure 8B:
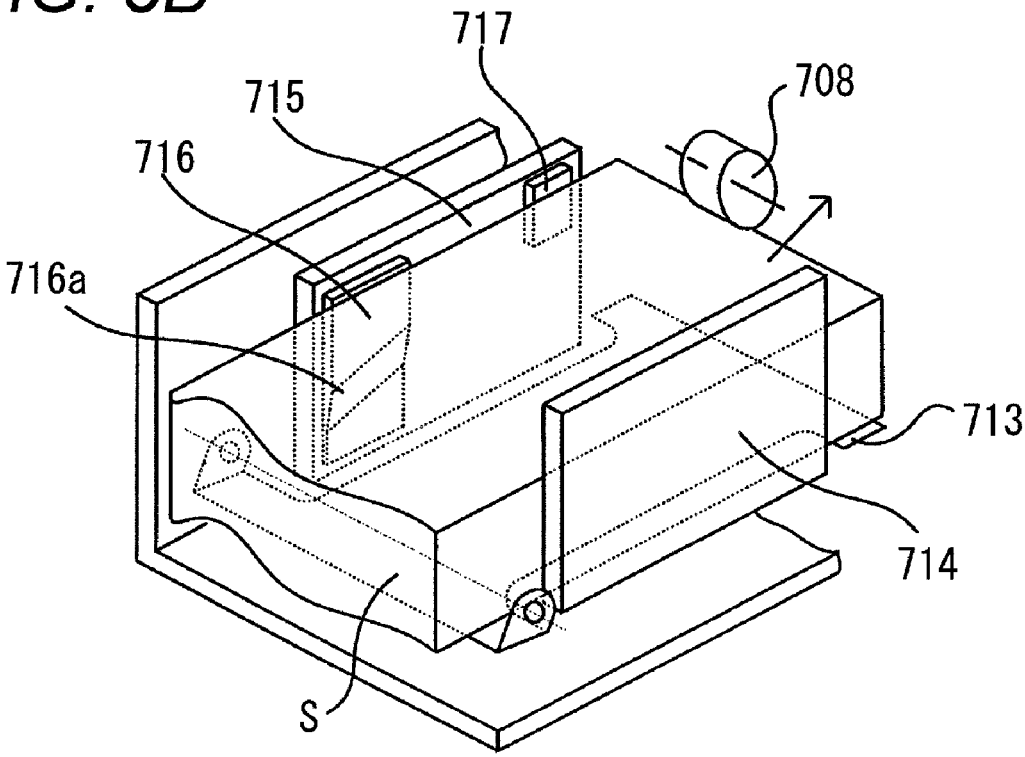
Figure 9A:
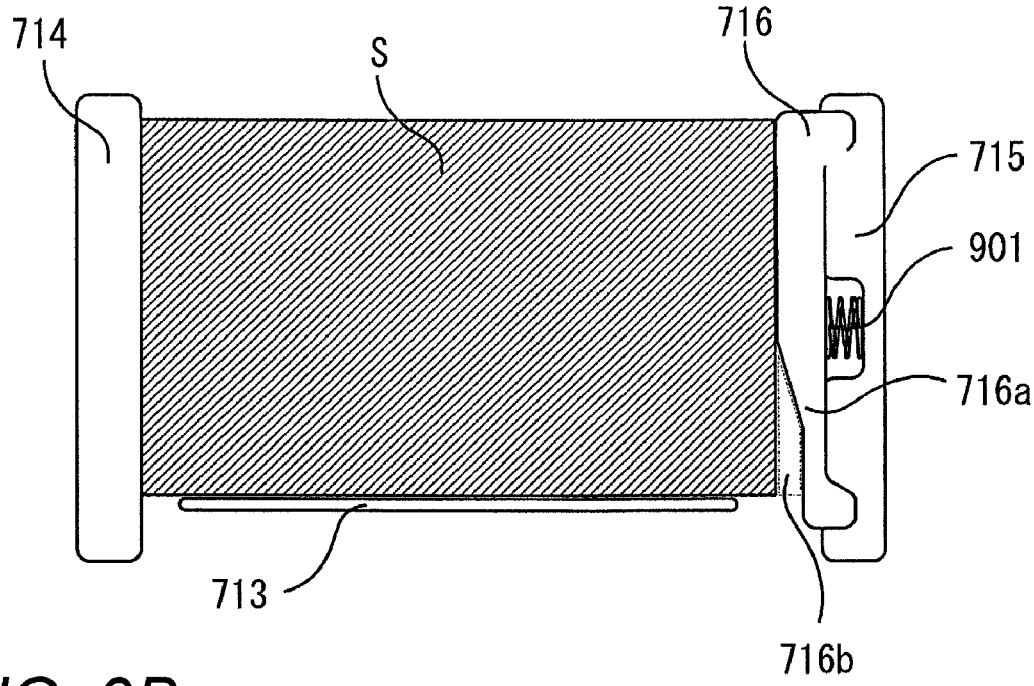
FIGS. 9A and 9B are views illustrating problems of the conventional sheet feeding cassette.
Figure 9B:
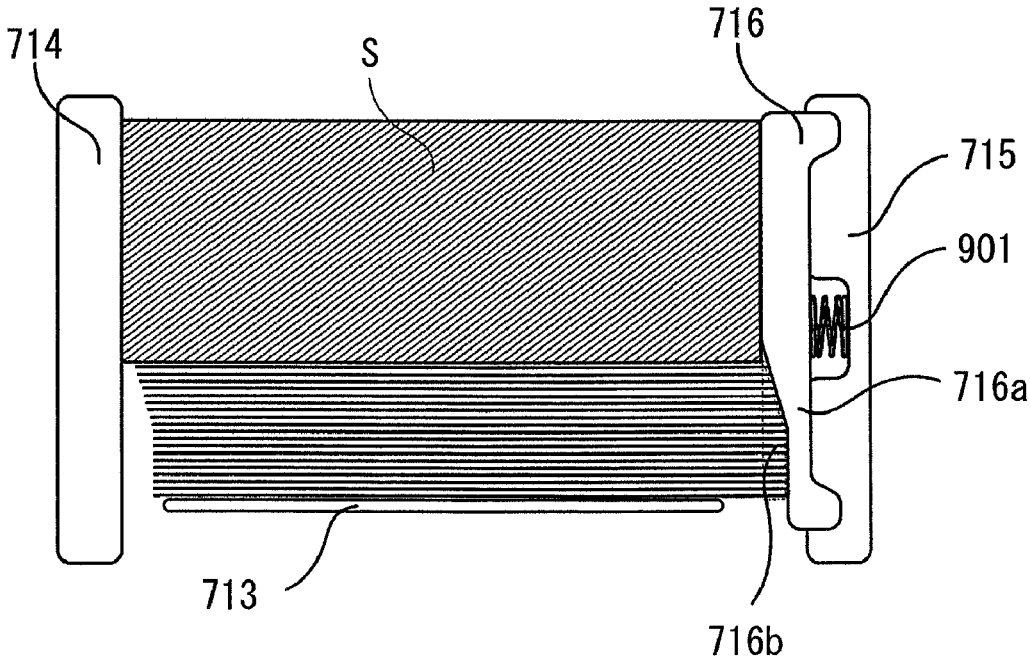

Next, a fourth embodiment of the present invention will be described, which is provided with the auxiliary sheet pressing portion. FIG. 7 is a perspective view illustrating a sheet feeding cassette mounted to an image forming apparatus according to this embodiment. Note that, in FIG. 7, components denoted by the same reference symbols as those of FIGS. 3A and 3B described above represent the same or corresponding components illustrated in FIGS. 3A and 3B. The fourth embodiment of the present invention will be described.

With reference to FIG. 7, an auxiliary sheet pressing portion 601 is provided inside the relief shape 116*a* formed in the sheet pressing portion 116. Here, the auxiliary sheet pressing portion 601 is provided inside the relief shape 116*a* in this manner, and hence, even in a case where the relief shape 116*a* is formed, it is possible to prevent the occurrence of positional shift of the sheets S. Further, by arranging the auxiliary sheet pressing portion 601 as described above inside the relief shape 116*a*, the pressing force of the sheet pressing portion 116, which is exerted on the sheets S during feeding in a low-level stack state, can be set to a pressing force small enough to prevent the occurrence of warpage of the sheets S. In addition, by arranging the auxiliary sheet pressing portion 601 inside the relief shape 116*a*, the configuration of the sheet pressing portion 116 can be made compact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-204737, filed Sep. 13, 2010, which is hereby incorporated by reference herein in its entirety.

What is claimed is:

1. A sheet feeding apparatus, which feeds, by a sheet feeding portion, sheets stored in a sheet feeding cassette detachably mounted to an apparatus main body, the sheet feeding apparatus comprising:

the sheet feeding cassette including:

a cassette main body in which the sheets are stored;

a sheet stacking portion provided on the cassette main body so as to pivot in an up-down direction, the sheet stacking portion pressing the stacked sheets onto the sheet feeding portion, and pivoting sequentially and upward when the sheets are fed so that an amount of stack of the sheets is reduced;

a pair of side edge regulating portions provided on the cassette main body to be opposed to each other, and configured to regulate positions of side edges in a width direction orthogonal to a sheet feeding direction of the sheets stacked on the sheet stacking portion, at least one of the pair of side edge regulating portions being movable in the width direction; and a sheet pressing portion provided in an urged state on the one of the pair of side edge regulating portions, the sheet pressing portion pressing the side edges of the sheets to press the sheets onto another one of the pair of side edge regulating portions, the sheet pressing portion including:

a pressing portion configured to press the side edges of the sheets; and a recessed portion intersecting the pressing portion, the recessed portion being formed to be inclined so that a downstream edge in the sheet feeding direction of a lower surface of the recessed portion is located higher than an upstream edge in the sheet feeding direction of an upper surface of the recessed portion.

2. A sheet feeding apparatus according to claim 1, wherein, when the sheet stacking portion pivots upward by a predetermined amount in association with a reduction of the stacked sheets, the recessed portion is formed to be inclined parallel to the sheets stacked on the sheet stacking portion, and formed to have a width in the up-down direction which is equal to or larger than a height of the sheets stacked on the sheet stacking portion pivoting upward by the predetermined amount.

3. A sheet feeding apparatus according to claim 1, wherein the sheet pressing portion comprises:

an upper sheet pressing portion including the recessed portion; and a lower sheet pressing portion divided from the upper sheet pressing portion by the recessed portion.

4. A sheet feeding apparatus according to claim 1, further comprising an auxiliary sheet pressing portion extending in the up-down direction in a vicinity of the sheet pressing portion of the one of the pair of side edge regulating portions which is movable, the auxiliary sheet pressing portion pressing the sheets at least when the sheet stacking portion pivots upward by a predetermined amount, and having a pressing force which is set to be weaker than a pressing force of the sheet pressing portion.

5. A sheet feeding apparatus according to claim 1, further comprising an auxiliary sheet pressing portion provided inside the recessed portion, the auxiliary sheet pressing portion pressing the sheets at least when the sheet stacking portion pivots upward by a predetermined amount, and having a pressing force which is set to be weaker than a pressing force of the sheet pressing portion.

6. An image forming apparatus, comprising:

a sheet feeding apparatus, which feeds, by a sheet feeding portion, sheets stored in a sheet feeding cassette detachably mounted to an apparatus main body; and an image forming portion configured to form images on the sheets fed by the sheet feeding apparatus, the image forming apparatus comprising:

the sheet feeding cassette including:

a cassette main body in which the sheets are stored;

a sheet stacking portion provided on the cassette main body so as to pivot in an up-down direction, the sheet stacking portion pressing the stacked sheets onto the sheet feeding portion, and pivoting sequentially and upward when the sheets are fed so that an amount of stack of the sheets is reduced;

a pair of side edge regulating portions provided on the cassette main body to be opposed to each other, and configured to regulate positions of side edges in a width direction orthogonal to a sheet feeding direction of the sheets stacked on the sheet stacking portion, at least one of the pair of side edge regulating portions being movable in the width direction; and a sheet pressing portion provided in an urged state on the one of the pair of side edge regulating portions, the sheet pressing portion pressing the side edges of the sheets to press the sheets onto another one of the pair of side edge regulating portions, the sheet pressing portion including:

a pressing portion configured to press the side edges of the sheets; and a recessed portion intersecting the pressing portion, the recessed portion being formed to be inclined so that a downstream edge in the sheet feeding direction of a lower surface of the recessed portion is located higher than an upstream edge in the sheet feeding direction of an upper surface of the recessed portion.

7. An image forming apparatus according to claim 6, wherein, when the sheet stacking portion pivots upward by a predetermined amount in association with a reduction of the stacked sheets, the recessed portion is formed to be inclined parallel to the sheets stacked on the sheet stacking portion, and formed to have a width in the up-down direction which is equal to or larger than a height of the sheets stacked on the sheet stacking portion pivoting upward by the predetermined amount.

8. An image forming apparatus according to claim 6, wherein the sheet pressing portion comprises:

an upper sheet pressing portion including the recessed portion; and a lower sheet pressing portion divided from the upper sheet pressing portion by the recessed portion.

9. An image forming apparatus according to claim 6, further comprising an auxiliary sheet pressing portion extending in the up-down direction in a vicinity of the sheet pressing portion of the one of the pair of side edge regulating portions which is movable, the auxiliary sheet pressing portion pressing the sheets at least when the sheet stacking portion pivots upward by a predetermined amount, and having a pressing force which is set to be weaker than a pressing force of the sheet pressing portion.

10. An image forming apparatus according to claim 6, further comprising an auxiliary sheet pressing portion provided inside the recessed portion, the auxiliary sheet pressing portion pressing the sheets at least when the sheet stacking portion pivots upward by a predetermined amount, and having a pressing force which is set to be weaker than a pressing force of the sheet pressing portion.

* * * * *